US010160237B2

(12) United States Patent
Herrmann

(10) Patent No.: US 10,160,237 B2
(45) Date of Patent: Dec. 25, 2018

(54) CROSS ROLL REGISTRATION SYSTEM WITH CONTROLLED INPUT POSITIONING

(71) Applicant: Xerox Corporation, Norwalk, CT (US)

(72) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/341,342

(22) Filed: Nov. 2, 2016

(65) Prior Publication Data

US 2018/0117934 A1 May 3, 2018

(51) Int. Cl.

| | |
|---|---|
| ***B65H 9/16*** | (2006.01) |
| ***B65H 9/00*** | (2006.01) |
| ***B41J 13/26*** | (2006.01) |

(52) U.S. Cl.

CPC ..... *B41J 13/26* (2013.01); *B65H 9/16* (2013.01); *B65H 9/002* (2013.01); *B65H 9/166* (2013.01); *B65H 2404/1424* (2013.01)

(58) Field of Classification Search

CPC ..... B65H 9/166; B65H 9/16; B65H 9/002
See application file for complete search history.

(56) References Cited

U.S. PATENT DOCUMENTS 4,426,073 A * 1/1984 Mizuma ..... B65H 5/068 271/251
4,971,304 A * 11/1990 Lofthus ..... B65H 7/06 198/395
5,094,442 A * 3/1992 Kamprath ..... B65H 9/002 271/227
5,162,857 A * 11/1992 Higeta ..... G03G 15/234 271/251
6,019,365 A * 2/2000 Matsumura ..... B65H 7/10 271/227
7,258,340 B2 8/2007 Clark et al.
7,611,142 B2 * 11/2009 Kawashima ..... B65H 9/002 271/228
7,628,398 B2 12/2009 Elliot
8,328,188 B2 12/2012 Mandel et al.
9,555,992 B2 * 1/2017 Yamashita ..... B65H 9/166
9,751,708 B2 * 9/2017 Hagihara ..... B65H 5/062
2016/0280488 A1 * 9/2016 Watanabe ..... B65H 5/062

FOREIGN PATENT DOCUMENTS

JP 58109344 A * 6/1983 ..... B65H 9/166
JP 2001151388 A * 6/2001

* cited by examiner

*Primary Examiner* — Luis A Gonzalez
(74) *Attorney, Agent, or Firm* — Simpson & Simpson, PLLC

(57) ABSTRACT

A media handling system for contacting a sheet of media against an alignment stop. The system including a pre-registration device and a cross roll registration device. The pre-registration device is configured to position the sheet of media at an approach angle and a cross process offset relative to the alignment stop. The cross roll registration device is configured to move the sheet of media positioned at the approach angle and the cross process offset into contact with the alignment stop.

18 Claims, 4 Drawing Sheets

CROSS ROLL REGISTRATION SYSTEM WITH CONTROLLED INPUT POSITIONING

TECHNICAL FIELD

The presently disclosed embodiments are directed to a system for aligning sheets of media, more particularly to a cross roll registration system for aligning sheets of media against an alignment stop, and even more particularly to a cross roll registration system for aligning sheets of media against an alignment stop having controlled input positioning of the sheets of media.

BACKGROUND

Advanced printing systems, e.g., recently developed ink jet printer systems, are capable of running at higher speeds and using lighter weight materials. Due to the increased running speeds and lighter weight materials, a registration system capable of handling these conditions is required.

Cross roll systems offer registration accuracy at increased speeds; however, cross roll registration systems are susceptible to sheet damage at the lead edge when the incoming registration allows the sheet to impact into the cross roll registration edge, e.g., an alignment stop. This issue is particularly relevant when using lightweight media. It has been found that lightweight media sheets do not have the beam strength required to prevent buckling as each sheet is registered against a solid registration edge, e.g., an alignment stop. This issue often presents in the form of a curled corner at the lead edge due to the corner being the first impact location of the sheet against the solid registration edge.

Current designs of cross roll systems show excellent registration within a reduced subset of media. It is well known that, because cross roll systems register a sheet against a solid registration wall the theoretical error is quite small. Studies of various non-cross roll registration systems show that the capabilities of cross roll systems can exceed the performance of those systems.

Even if the forces on the cross rolls are controlled for various paper weights, the sheets are still at risk of being damaged. This can be attributed to the fact that cross roll registration systems, as standalone systems, do not control the extent of skew of the sheet or initially register the sheet so that the sheet contacts the registration wall at an optimum angle or optimum position to reduce damage to the sheet.

SUMMARY

The present disclosure sets forth the use of a cross roll registration system with an expanded media set by adding an upstream pre-registration system which induces a specific input skew, i.e., approach angle, and lateral movement, i.e., cross process offset, to optimize the downstream cross roll system performance.

It has been found that by handing off the sheets to the cross roll system with an optimized skew and lateral position setting, the entire system can be optimized to use a solid edge registration wall without media damage caused by an uncontrolled incoming skew and lateral positioning to the cross roll system.

Broadly, the present disclosure sets forth a media handling system for contacting a sheet of media against an alignment stop. The system including a pre-registration device and a cross roll registration device. The pre-registration device is configured to position the sheet of media at an approach angle and a cross process offset relative to the alignment stop. The cross roll registration device is configured to move the sheet of media positioned at the approach angle and the cross process offset into contact with the alignment stop.

Moreover, the present disclosure sets forth a method of moving a sheet of media into contact with an alignment stop. The method includes: a) positioning the sheet of media at an approach angle and a cross process offset relative to the alignment stop with a pre-registration device; and, b) moving the sheet of media into contact with the alignment stop with a cross roll registration device.

Other objects, features and advantages of one or more embodiments will be readily appreciable from the following detailed description and from the accompanying drawings and claims.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

Figure 1:
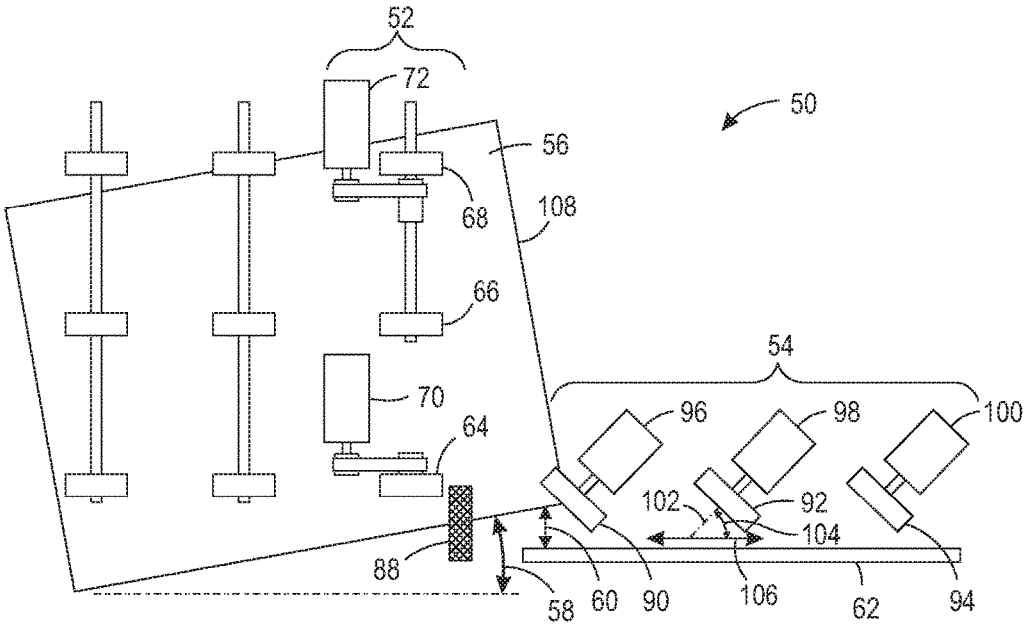
FIG. 1 is a top plan view of an embodiment of a present cross roll registration system with a pre-registration controlled input positioning system included therewith having a sheet of media within the pre-registration system.
Figure 2:
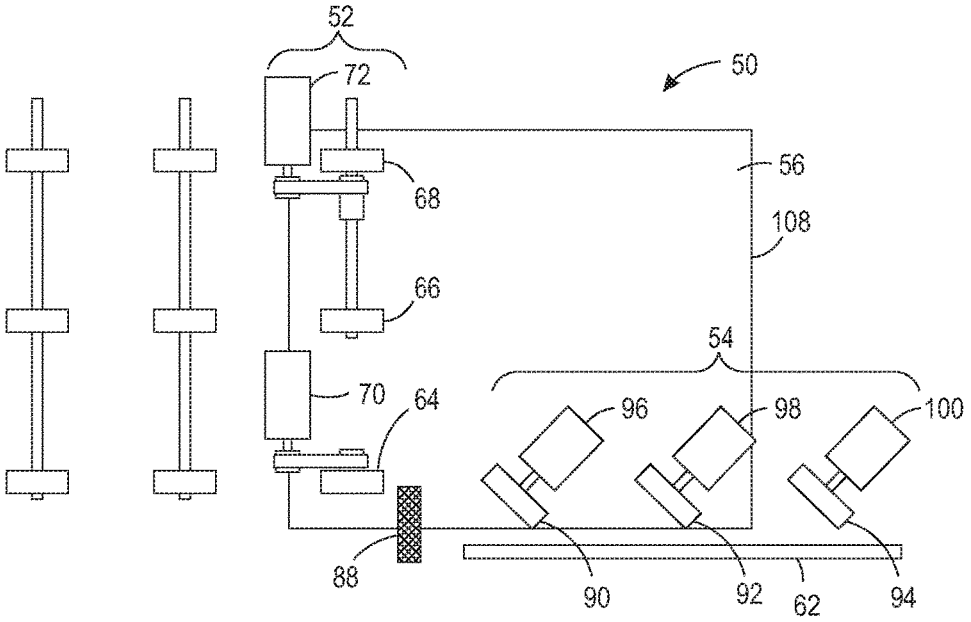
FIG. 2 is a top plan view of the embodiment of a present cross roll registration system with a pre-registration controlled input positioning system included therewith shown in FIG. 1 having a sheet of media passing from the pre-registration system to the cross roll registration system.
Figure 3:
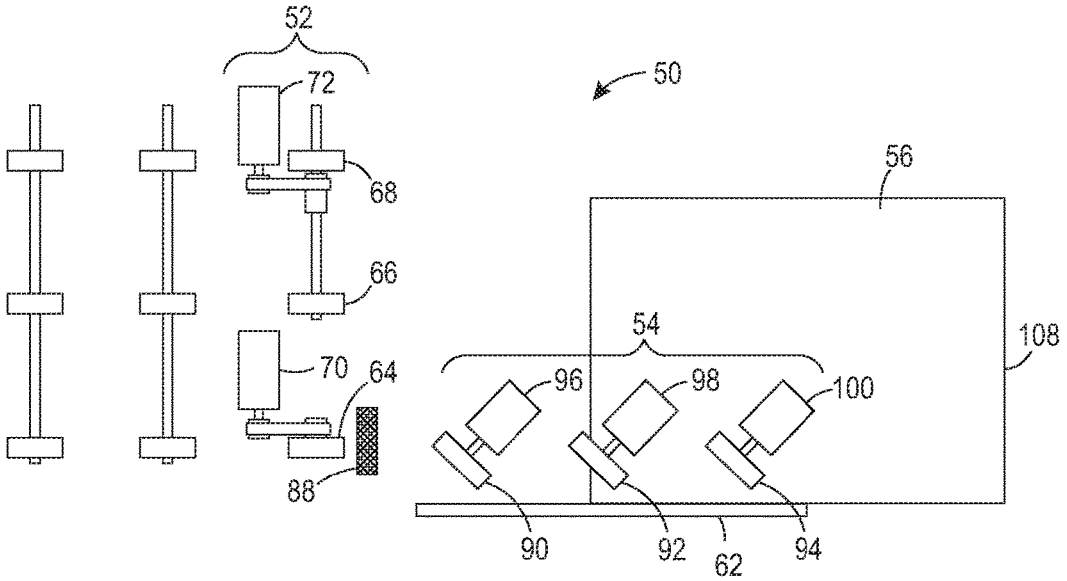
FIG. 3 is a top plan view of the embodiment of a present cross roll registration system with a pre-registration controlled input positioning system included therewith shown in FIG. 1 having a sheet of media passing within the cross roll registration system.
Figure 4:
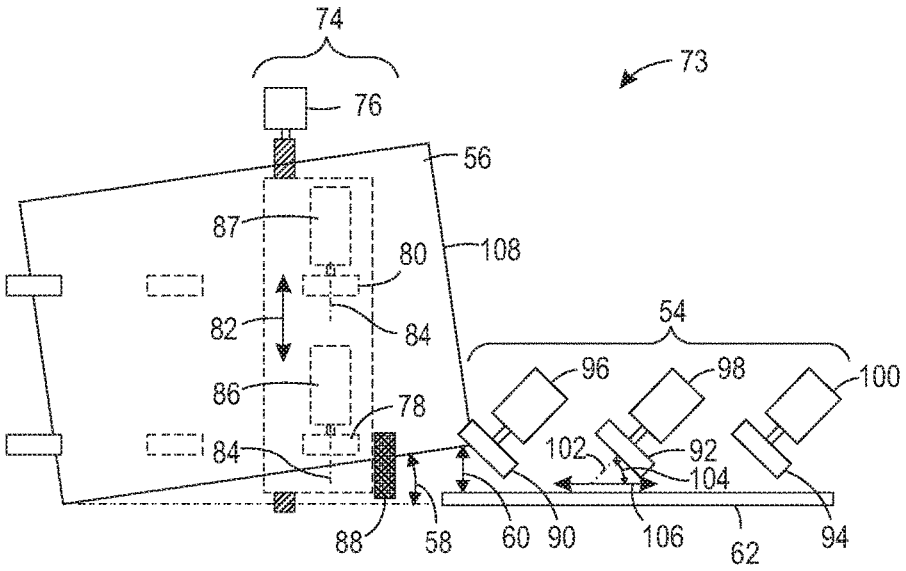
FIG. 4 is a top plan view of another embodiment of a present cross roll registration system with a pre-registration controlled input positioning system included therewith having a sheet of media within the pre-registration system.
Figure 5:
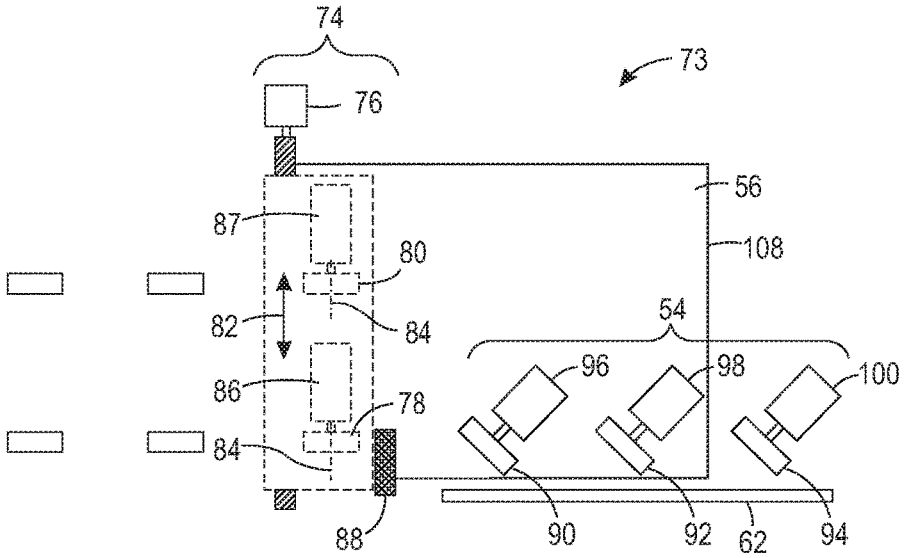
FIG. 5 is a top plan view of the embodiment of a present cross roll registration system with a pre-registration controlled input positioning system included therewith shown in FIG. 4 having a sheet of media passing from the pre-registration system to the cross roll registration system.
Figure 6:
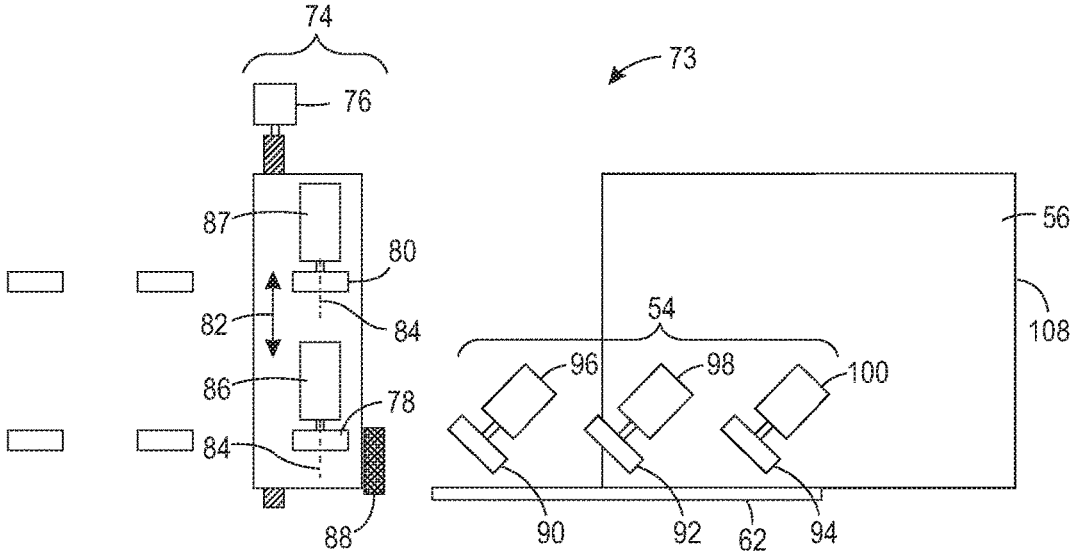
FIG. 6 is a top plan view of the embodiment of a present cross roll registration system with a pre-registration controlled input positioning system included therewith shown in FIG. 4 having a sheet of media passing within the cross roll registration system; and, FIG. 7 is a top plan view of an embodiment of a present cross roll registration system with a pre-registration controlled input positioning system included therewith having a sheet of media within the pre-registration system.
Figure 7:
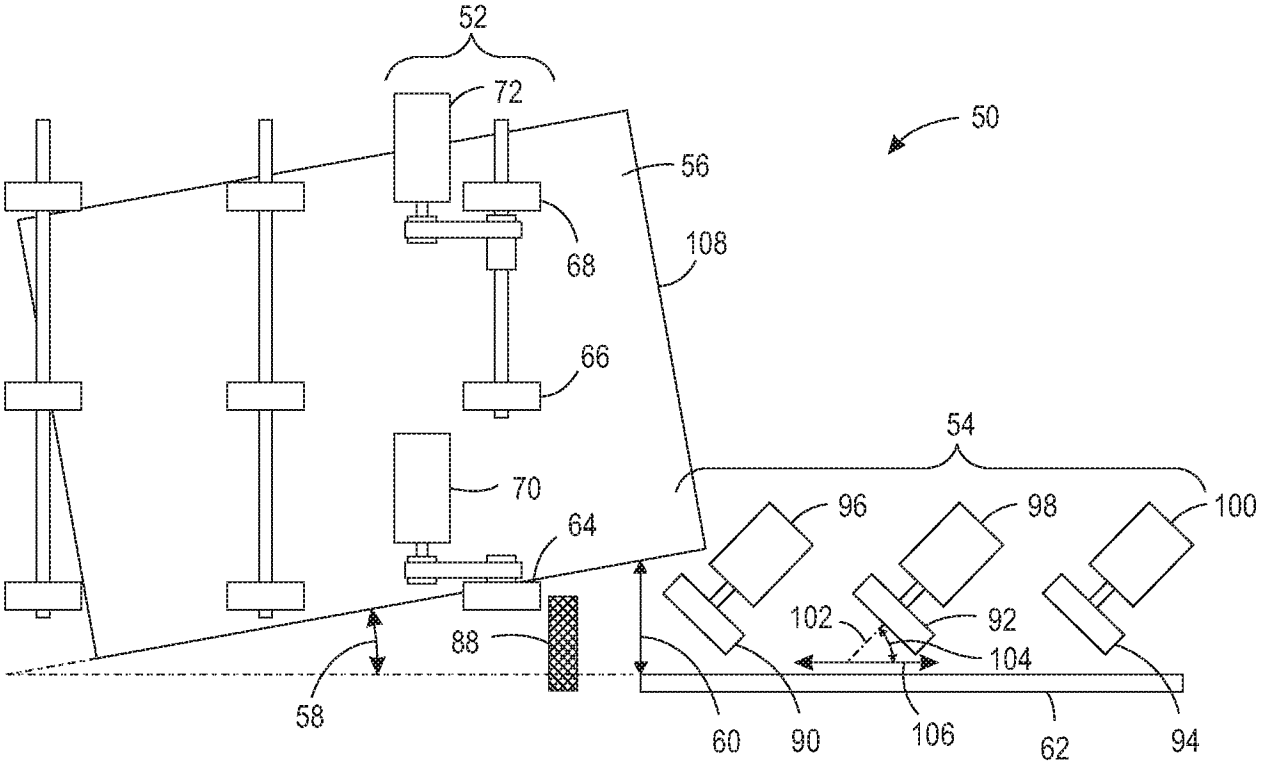

At the outset, it should be appreciated that like drawing numbers on different drawing views identify identical, or functionally similar, structural elements of the embodiments set forth herein. Furthermore, it is understood that these embodiments are not limited to the particular methodology, materials and modifications described and as such may, of course, vary. It is also understood that the terminology used herein is for the purpose of describing particular aspects only, and is not intended to limit the scope of the disclosed embodiments, which are limited only by the appended claims.

Unless defined otherwise, all technical and scientific terms used herein have the same meaning as commonly understood to one of ordinary skill in the art to which these embodiments belong.

Furthermore, as used herein, the term 'average' shall be construed broadly to include any calculation in which a result datum or decision is obtained based on a plurality of input data, which can include but is not limited to, weighted averages, yes or no decisions based on rolling inputs, etc. The term 'device', as used herein, shall mean any arrangement of hardware and associated control software, which may be embedded in larger systems or programs, having a described purpose or function associated therewith. For example, a cross roll registration device is an arrangement of hardware and associated control software, which is typically incorporated within a larger printing system, that aligns a sheet of media against a locating surface by means of rolls positioned at least partially in a cross process direction.

Moreover, although any methods, devices or materials similar or equivalent to those described herein can be used in the practice or testing of these embodiments, some embodiments of methods, devices, and materials are now described.

The following is best understood in view of the various embodiments depicted in the accompanying figures. The present disclosure sets forth various embodiments of a media handling system for contacting a sheet of media against an alignment stop. In some embodiments, system 50 comprises pre-registration device 52 and cross roll registration device 54. Pre-registration device 52 is configured to position sheet of media 56 at an approach angle, e.g., angle 58, and a cross process offset, e.g., offset 60, each relative to alignment stop 62. Cross roll registration device 54 is configured to move sheet of media 56, initially positioned at approach angle 58 and cross process offset 60, into contact with alignment stop 62.

In some embodiments, pre-registration device 52 comprises at least two driven pre-registration wheels, e.g., pre-registration wheels 64, 66 and 68 and at least two motors, e.g., motors 70 and 72. In some embodiments, each motor is arranged to independently drive one of the at least two driven pre-registration wheels. For example, motor 70 drives pre-registration wheel 64. In some embodiments, some or all of the motors are arranged to independently drive two or more of the driven pre-registration wheels. For example, motor 72 drives pre-registration wheels 66 and 68. In some embodiments, pre-registration device 52 is arranged to perform at least one of the following: rotate sheet of media 56 to approach angle 58; and, translate sheet of media 56 to cross process offset 60.

In some embodiments, e.g., alignment system 73, pre-registration device 74 further comprises cross-process driver 76 arranged to move driven pre-registration wheels 78 and 80 in a cross-process direction, i.e., the direction depicted by bi-directional arrow 82. In some embodiments, each of driven pre-registration wheels 78 and 80 has an axis of rotation, e.g., axis of rotation 84, parallel to cross-process direction 82. Moreover, in some embodiments, pre-registration wheels 78 and 80 may be driven by motors 86 and 87, respectively, while in other embodiments, pre-registration wheels 78 and 80 may be driven by a single motor and are rotationally connected by any means known in the art.

It should be appreciated that approach angle 58 and lateral offset 60 may be measured using any means known in the art. For example, photosensors 88 may be arranged in a cross process orientation and used to detect approach angle 58 and lateral offset 60. One of ordinary skill in the art will appreciate that other means may also be used, and such variations fall within the scope of the recited claims.

In some embodiments, cross roll registration device 54 comprises at least one driven registration wheel, e.g., registration wheels 90, 92 and 94, and at least one motor, e.g., motors 96, 98 and 100, arranged to drive the at least one driven registration wheel. In some embodiments, each driven registration wheel, e.g., wheel 92 has axis of rotation 102 arranged at an acute angle, e.g., angle 104, relative to a process direction, the direction depicted by bi-directional arrow 106.

In some embodiments, cross roll registration device 54 comprises at least two driven registration wheels, e.g., registration wheels 90, 92 and 94, and at least one motor, e.g., motor 96, arranged to drive driven registration wheels 90, 92 and 94. Although not depicted in the figures, the foregoing arrangement would require a mechanical coupling linking the rotation of one registration wheel to the rotation of another registration wheel. Such mechanical coupling may be a driven shaft comprising a spline, helical grooves, etc., wherein the mechanical coupling simultaneously acts upon each registration wheel. In some embodiments, cross roll registration device 54 comprises at least two motors, e.g., motors 96, 98 and 100, each arranged to drive one of the at least two driven registration wheels. For example, motor 96 drives registration wheel 90, motor 98 drives registration wheel 92 and motor 100 drives registration wheel 94. In some embodiments, each of the at least two driven registration wheels has an axis of rotation arranged at an acute angle relative to process direction 106, e.g., registration wheels 90, 92 and 94 having respective axes of rotation arranged at angles the same or different than angle 104.

In some embodiments, sheet of media 56 comprises first edge 108 adjacent alignment stop 62. First edge 108 is positioned at an acute angle relative to alignment stop 62 when sheet of media 56 is positioned at approach angle 58.

It should be appreciated that the foregoing system may be used to move sheet of media 56 into contact with alignment stop 62. In some embodiments, a present method comprises: a) positioning sheet of media 56 at approach angle 58 and cross process offset 60 relative to alignment stop 62 using pre-registration device 52 or 74; and, b) moving sheet of media 56 into contact with alignment stop 62 using cross roll registration device 54.

The foregoing embodiments use various combinations of upstream registration systems and cross roll systems, thereby making use of the improved registration possible with a cross roll system. By providing the downstream cross roll registration system with an optimized incoming skew and lateral displacement for a particular media, the cross roll system is then able to register the sheet against the solid registration wall with a minimum lateral force and at an optimum angle, to improve overall system performance.

The placement of the sheet of media is then the result of a transfer function that takes the incoming skew and sets it to minimize sheet damage on the cross roll registration function. The outputs of the first registration transfer function then become the inputs to the cross roll registrations transfer function. These transfer functions are then optimized to provide optimum registration wall contact in the cross roll system. The overall lateral force is reduced and the application of the force is controlled as well. As a cross roll system has no intelligence in controlling the angle at which media strikes the solid registration wall, the leading edge corner is driven into the solid wall. This sheet corner will then have to withstand cross roll forces applied along the entire sheet. The foregoing results in sheet damage.

Use of a controlled upstream skew and lateral positioning allows for and optimizes motion within the cross roll registration system so that media is registered against a solid registration wall without incurring suboptimum position and forces on the sheet caused by uncontrolled incoming skew and lateral positioning. In this way, the various embodiments of the present system exhibit the benefits of a cross roll registration system on a wider range of media types.

The present system is capable of controlling the input skew and lateral registration to minimize buckling through the addition of cross roll registration thereby achieving high levels of registration accuracy. Thus, a tandem registration system is included to add a calculated amount of skew and lateral offset to allow for lightweight materials to registered using a cross roll system without damage. The foregoing system is a dual registration system that provides a first level of registration correction combined with a secondary registration system capable of higher levels of registration accuracy without sacrificing lower paper weights, speed or throughput. It should be appreciated that the present system can control and set input skew and lateral offset to minimize sheet damage based on predictive and programmed media parameters. In short, the present system is calibrated or configured to skew and offset particular media based on the needs of the media, i.e., the skew and offset necessary to minimize media damage on alignment. In other terms, the present system minimizes buckling issues on lighter weight papers and provides for optimum attack angle for the cross roll registration system.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A media handling system for contacting a sheet of media against an alignment stop, the system comprising:

a pre-registration device configured to position the sheet of media at an approach angle and a cross process offset relative to the alignment stop, the pre-registration device comprising:

at least two driven pre-registration wheels;

at least two motors each arranged to independently drive one of the at least two driven pre-registration wheels; and, a cross-process driver arranged to move the at least two driven pre-registration wheels in the cross-process direction; and, a cross roll registration device configured to move the sheet of media positioned at the approach angle and the cross process offset into contact with the alignment stop, wherein the pre-registration device is arranged to perform the following: rotate the sheet of media to the approach angle; and, translate the sheet of media in a cross-process direction to the cross process offset, and wherein the pre-registration device induces lateral movement of the sheet of media in the cross-process direction.

2. The media handling system of claim 1 wherein each of the at least two driven pre-registration wheels has an axis of rotation parallel to the cross-process direction.

3. The media handling system of claim 1 wherein the cross roll registration device comprises:

at least one driven registration wheel; and, at least one motor arranged to drive the at least one driven registration wheel.

4. The media handling system of claim 3 wherein the driven registration wheel has an axis of rotation arranged at an acute angle relative to a process direction.

5. The media handling system of claim 1 wherein the cross roll registration device comprises:

at least two driven registration wheels; and, at least one motor arranged to drive the at least two driven registration wheels.

6. The media handling system of claim 5 wherein the cross roll registration device comprises:

at least two motors each arranged to drive one of the at least two driven registration wheels.

7. The media handling system of claim 5 wherein each of the at least two driven registration wheels has an axis of rotation arranged at an acute angle relative to a process direction.

8. The media handling system of claim 1 wherein the sheet of media comprises a first edge adjacent the alignment stop, and the first edge is positioned at an acute angle relative to the alignment stop when the sheet of media is positioned at the approach angle.

9. A method of moving a sheet of media into contact with an alignment stop comprising:

a) positioning the sheet of media at an approach angle and a cross process offset relative to the alignment stop with a pre-registration device; and, b) moving the sheet of media into contact with the alignment stop with a cross roll registration device, wherein the pre-registration device is arranged to perform the following: rotate the sheet of media to the approach angle; and, translate the sheet of media in a cross-process direction to the cross process offset, and wherein the pre-registration device induces lateral movement of the sheet of media in the cross-process direction.

10. The method of claim 9 wherein the pre-registration device comprises:

at least two driven pre-registration wheels; and, at least two motors each arranged to independently drive one of the at least two driven pre-registration wheels.

11. The method of claim 10 wherein the pre-registration device further comprises:

a cross-process driver arranged to move the at least two driven pre-registration wheels in the cross-process direction.

12. The method of claim 10 wherein each of the at least two pre-registration driven wheels has an axis of rotation parallel to the cross-process direction.

13. The method of claim 9 wherein the cross roll registration device comprises:

at least one driven registration wheel; and, at least one motor arranged to drive the at least one driven registration wheel.

14. The method of claim 13 wherein the driven registration wheel has an axis of rotation arranged at an acute angle relative to a process direction.

15. The method of claim 9 wherein the cross roll registration device comprises:

at least two driven registration wheels; and, at least one motor arranged to drive the at least two driven registration wheels.

16. The method of claim 15 wherein the cross roll registration device comprises:

at least two motors each arranged to drive one of the at least two driven registration wheels.

17. The method of claim 15 wherein each of the at least two driven registration wheels has an axis of rotation arranged at an acute angle relative to a process direction.

18. The method of claim 9 wherein the sheet of media comprises a first edge adjacent the alignment stop, and the first edge is positioned at an acute angle relative to the alignment stop when the sheet of media is positioned at the approach angle.

* * * * *